US005248054A

United States Patent [19]

Berggren et al.

[11] Patent Number: 5,248,054

[45] Date of Patent: Sep. 28, 1993

[54] OPENING ARRANGEMENT FOR A CONTAINER PACKAGE

[75] Inventors: Göran Berggren, Staffanstorp; Ulf Nedstedt, Eslöv, both of Sweden

[73] Assignee: Tetra Alfa Holdings SA, Pully, Switzerland

[21] Appl. No.: 937,952

[22] Filed: Sep. 1, 1992

[30] Foreign Application Priority Data

Sep. 4, 1991 [SE] Sweden ..... 9102532

[51] Int. Cl.[5] ..... B65D 41/34

[52] U.S. Cl. ..... 220/278; 215/226; 215/257; 229/125.14

[58] Field of Search ..... 215/250, 254, 202, 209, 215/226, 228, 257; 220/278, 277; 229/125.14, 125.15, 123.2

[56] References Cited

U.S. PATENT DOCUMENTS

| | | | |
|---|---|---|---|
| 948,392 | 2/1910 | Dougherty . | |
| 2,438,299 | 3/1948 | Relis | 220/278 |
| 3,339,812 | 9/1967 | Meissner . | |
| 4,527,700 | 7/1985 | Jupin et al. | 215/226 |
| 4,588,098 | 5/1986 | Uzdy | 220/250 |
| 4,634,013 | 1/1987 | Bar-Kokhba | 215/257 |
| 4,747,499 | 5/1988 | Gach et al. | 220/250 |
| 4,754,889 | 7/1988 | Debetencourt | 220/250 |
| 4,782,646 | 11/1988 | Nantin . | |
| 4,792,053 | 12/1988 | Towns et al. | 220/250 |
| 4,793,503 | 12/1988 | Towns et al. | 220/250 |
| 4,793,505 | 12/1988 | Towns et al. | 220/250 |
| 4,813,578 | 3/1989 | Gordon et al. | 220/125.14 |
| 4,898,293 | 2/1990 | Morel | 220/250 |
| 4,907,722 | 3/1990 | Ueda et al. | 220/278 |
| 5,082,136 | 1/1992 | Schumann | 220/278 |

FOREIGN PATENT DOCUMENTS

| | | | |
|---|---|---|---|
| 0039374 | 11/1981 | European Pat. Off. . | |
| 0247645 | 12/1987 | European Pat. Off. . | |
| 0252532 | 1/1988 | European Pat. Off. . | |
| 0326641 | 8/1989 | European Pat. Off. . | |
| 65165 | 1/1956 | France | 220/278 |
| 531816 | 3/1953 | Italy | 220/278 |
| 440894 | 8/1985 | Sweden . | |
| 2166718 | 5/1986 | United Kingdom . | |
| 2230520 | 10/1990 | United Kingdom . | |
| WO87/06220 | 10/1987 | World Int. Prop. O. . | |

*Primary Examiner*—Gary E. Elkins

*Attorney, Agent, or Firm*—Burns, Doane, Swecker & Mathis

[57] ABSTRACT

An opening arrangement for laminated container packages or cartons of the single-use disposable type includes an inner pouring spout, which is formed as a closed part continuous with the container package, and an outer, screw stopper-like sealing portion. Penetration devices are provided in the outer sealing portion, the penetration devices severing the inner pouring spout when the package is opened.

11 Claims, 4 Drawing Sheets

OPENING ARRANGEMENT FOR A CONTAINER PACKAGE

TECHNICAL FIELD

The present invention relates to an opening arrangement for container packages, comprising a sealing portion which inflexibly engages with and surrounds a pouring spout, whose end facing away from the container package consists of a continuous, liquid-tight material layer which is shaped in accordance with the inner configuration of the sealing portion.

BACKGROUND OF THE INVENTION

Container packages or cartons of the single-use disposable type are largely employed today to pack consumer goods such as, for example, beverages like milk or juice. The container package is usually made from packaging material in the form of a laminate with carrier layers of paperboard or cardboard, and different layers of thermoplastic laminated thereto. The laminate may also have a different core material, such as metal foil. The packaging material, which is often in the form of a web or sheet blank, is folded, sealed and finally formed into a liquid-tight container package.

The finished container package will preferably include an opening arrangement that is simple to open and pour from, which pours the liquid contents in a compact jet and without any risk of spilling or dripping. However, container packages manufactured from a packaging material consisting of a paper laminate may be difficult to tear open and fold to form a functional pouring spout. Moreover, when the intention is to reclose and reseal such container packages, it is not possible to make the package liquid-tight once again.

It is also known in the art to manufacture container packages having a main portion formed from a packaging laminate as described above, but having an upper defining surface formed from an injection moulded thermoplastic lid. The thermoplastic lid also includes an opening arrangement integral with the lid. This opening arrangement is relatively easy to open but is not liquid-tight on reclosure and resealing.

In order to obviate the above-outlined drawbacks, various forms of penetrating screw stoppers or plugs have been produced which are placed on the surface of the container package so that the screw plug penetrates through the surface layer when the package is opened.

It is further known in the art to form a partly integrated pouring spout from the surface of the packaging material. The pouring spout is surrounded by a sealing portion of the so-called screw stopper or plug type which, on being opened, tears off an outer portion of the pouring spout. That part of the pouring spout which is torn off during the opening operation has been sealed against the outer sealing portion by means of heat. As a result, the tear-off operation generally results in the pouring spout having a rough outer edge, which may render pouring of the contents enclosed in the container package difficult.

OBJECTS AND SUMMARY OF THE INVENTION

One object of the present invention is to provide an opening arrangement for container packages which, on opening, forms an aperture of the pouring spout with smooth edges.

This and other objects have been attained according to the present invention in that the opening arrangement of the type described by way of introduction includes in the upper region of the sealing portion, at least two penetration devices oriented inwardly in the pouring spout.

BRIEF DESCRIPTION OF THE DRAWINGS

A preferred embodiment of the present invention will now be described in greater detail hereinbelow with particular reference to the accompanying Drawings, in which.

The Drawings show only those details essential to an understanding of the present invention.

DESCRIPTION OF THE PREFERRED EMBODIMENT

Figure 1:
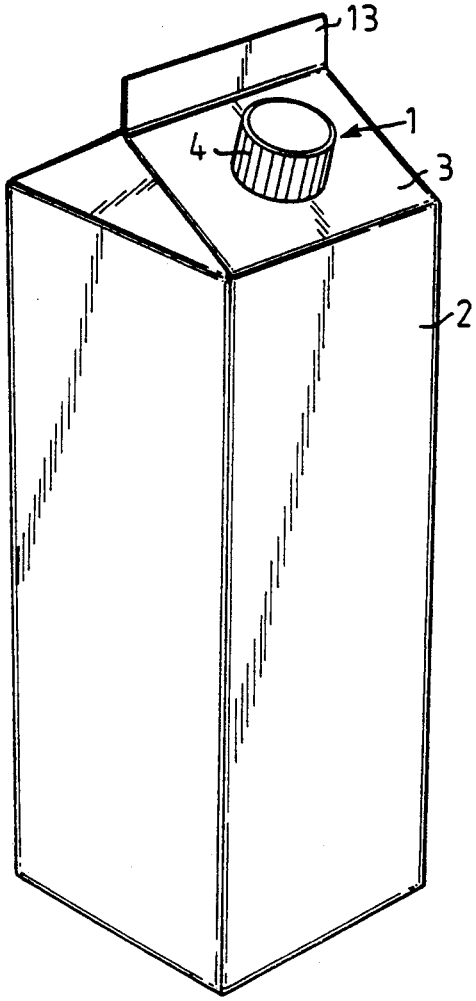
FIG. 1 is a perspective view of an opening arrangement according to embodiment of the present invention in a container package of known type.

FIG. 1 shows an opening arrangement 1 according to the present invention applied to a container package 2 of known type. The container package 2, which is manufactured from a laminate with a core of paper, cardboard or metal to which is laminated different layers of thermoplastic, is folded, sealed and formed into a so-called gable-top carton 2. The opening arrangement 1 is placed on one of the upper defining surfaces 3 of the carton 2 forming a so-called gable-top. FIG. 1 shows only the outer sealing portion 4 of the opening arrangement 1, this portion being formed as a screw stopper of substantially conventional type, with interior threading, or alternatively a snap top with an inner bead (not shown).

Figure 2:
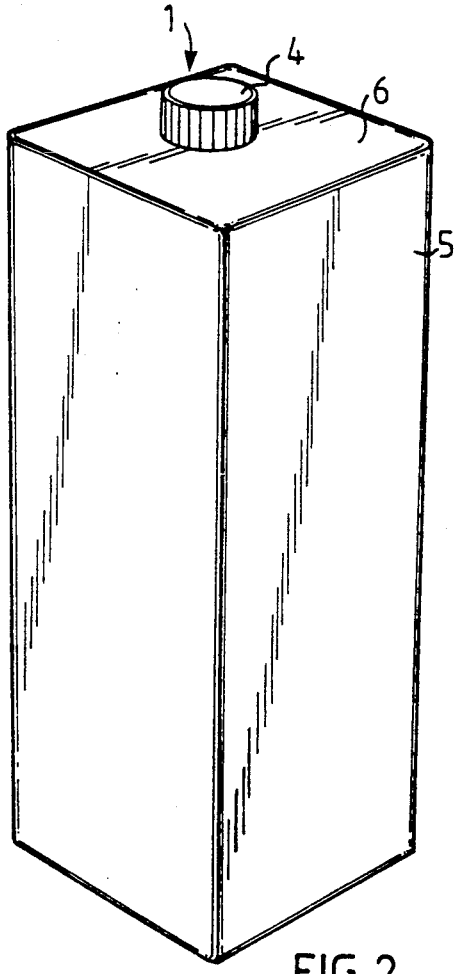
FIG. 2 is a perspective view of the opening arrangement according to an embodiment of the present invention in another type of container package.

FIG. 2 shows another type of container package 5 also of known type in which the lower portion of the container package 5 is manufactured from a laminate in accordance with the above description. The upper defining surface 6 of the container package 5 is formed from a thermoplastic panel, part of the surface of which has been formed into a pouring spout surrounded by an outer sealing portion 4. The remaining parts of the thermoplastic panel are folded about the upper edge of the container package 5 and are sealed by means of heat against the thermoplastic surface of the packaging laminate.

Figure 3A:
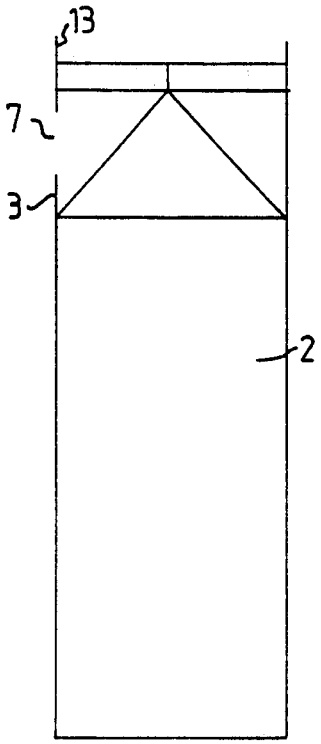
FIGS. 3A–E are schematic, partially cross-sectional views depicting the application of an opening arrangement according to an embodiment of the present invention to a container package such as is shown in FIG. 1.
Figure 3B:
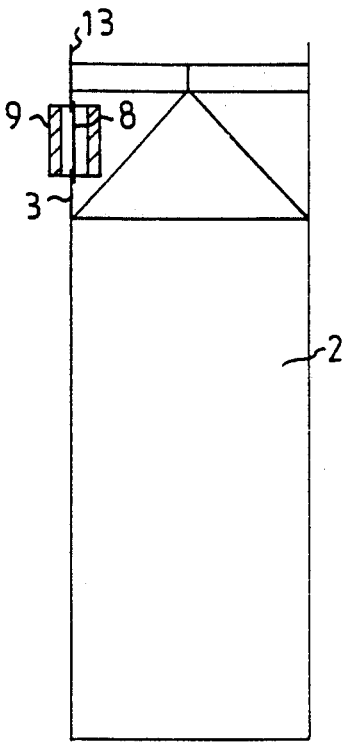

FIGS. 3A–E schematically show how an opening arrangement 1 according to the present invention is applied to a container package 2 such as is shown in FIG. 1. As circular opening 7 (FIG. 3A) is made in one of the upper sloping gable-top panels 3 of the container package 2. A thermoplastic panel 8 is placed inside the circular opening 7, this panel having a diameter which exceeds that of the circular opening 7 in the wall surface 3 of the container package 2. As shown in FIG. 3B, the thermoplastic panel 8 is sealed interiorly against the inner wall surface of the container package 2 by means of a sealing tool 9.

Figure 3C:
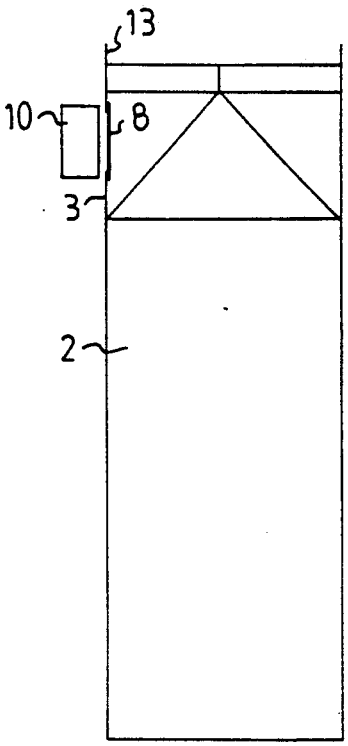
Figure 3D:
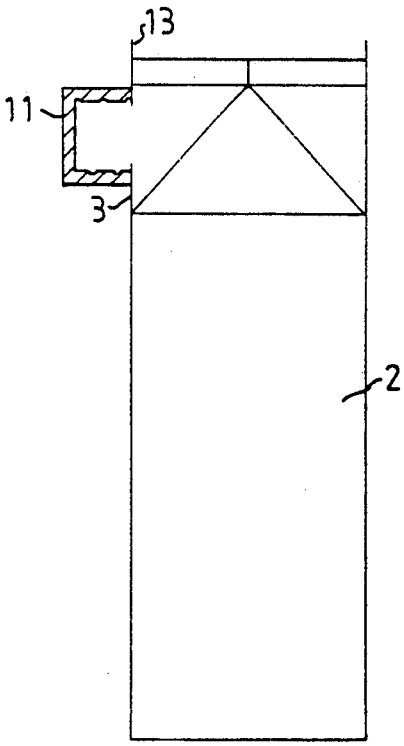
Figure 3E:
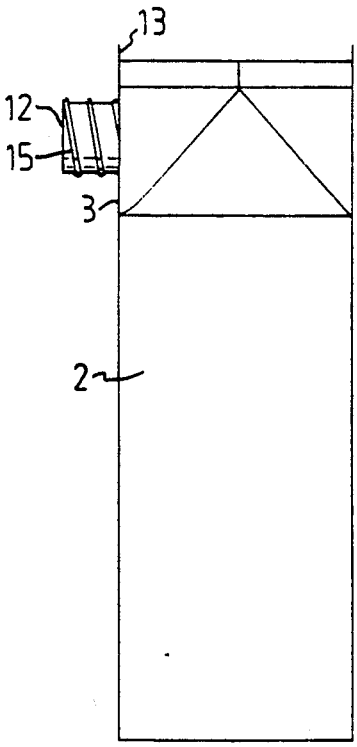

In FIG. 3C, the thermoplastic panel 8 is heated by a heater 10 to a temperature at which the thermoplastic plasticizes (for polyethylene approx. 110° C.). Once the thermoplastic panel 8 has become plasticized and pliable, it is subjected to vacuum or pressure forming in a molding tool 11 as illustrated in FIG. 3D. The outer sealing portion 4 is preferably used as the mold for vacuum forming the pouring spout 12 with threads 15. FIG. 3E finally shows the finished pouring spout 12 provided with threads 15. The pouring spout 1 is completely sealed and constitutes a liquid-tight part of the container package 2 when the outer sealing fin or flap 13 is finally sealed together after the filling operation.

Figure 4:
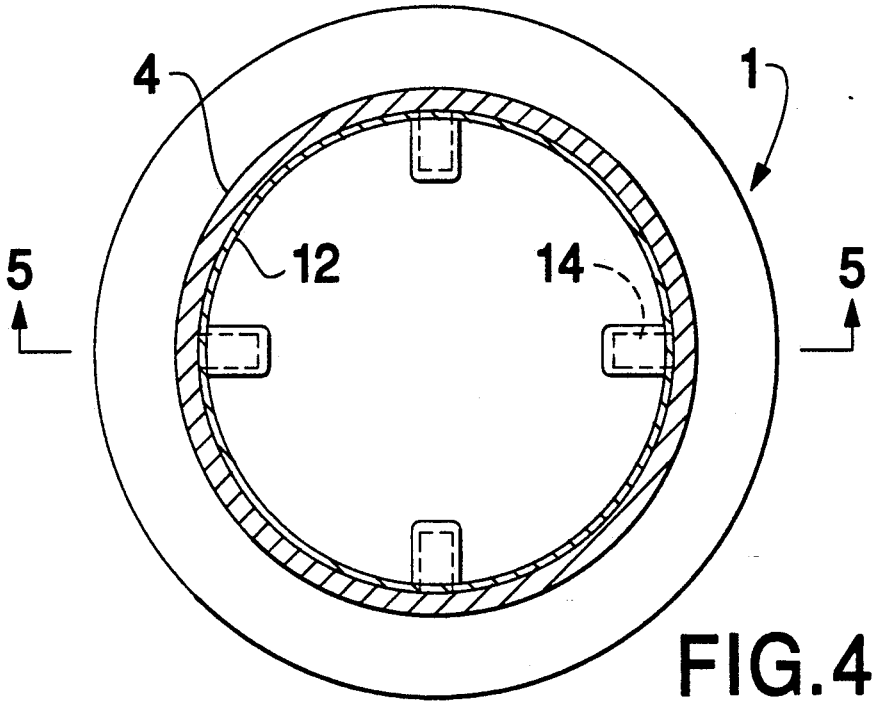
FIG. 4 is a partially cross-sectional top view of an opening arrangement according to an embodiment of the present invention.
Figure 5:
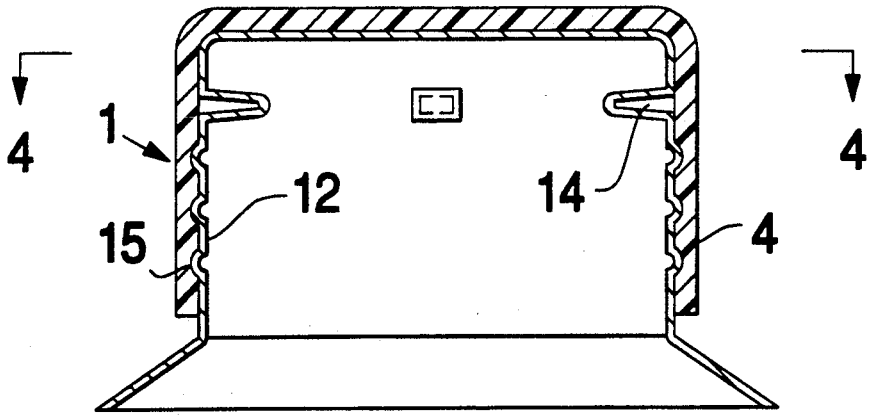
FIG. 5 is a partially cross-sectional view of an opening arrangement according to an embodiment of the present invention.

FIGS. 4 and 5 show the outer sealing portion 4 from two different views. The outer sealing portion 4 is preferably formed as conventional screw stopper or plug but there are provided, in its upper region, at least two, but preferably four penetration devices 14. These penetration devices 14 preferably are formed in the shape of small bevelled plastic pieces which project out from the inner wall of the sealing portion 4. They may also be formed from small metal pieces which have been fixed in place and which, on opening of the opening arrangement 1, easily penetrate the upper portion of the pouring spout 12.

In the vacuum forming of the pouring spout 12, when the outer sealing portion 4 serves as a mold, the plasticized thermoplastic will form itself about the penetration devices 14 without the plastic cracking or being severed in this position. By employing four penetration devices 14 placed at mutually different levels, on removal of the outer sealing portion 4, an even and horizontal outer edge of the pouring spout 12 is obtained. That part of the pouring spout 12 which is severed in the opening operation is retained by the penetration devices 14 in the upper region of the sealing portion 4. The number of penetration devices 14 is dependant upon the length and pitch of the thread 15. The longer the thread 15, the fewer will be the number of penetration devices 14 required. The penetration devices 14 must together be capable of cutting off a complete circular surface of the upper region of the pouring spout 12.

Figure 6:
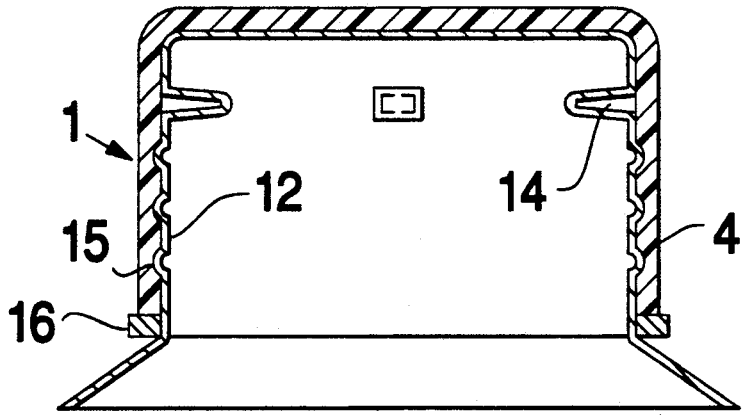
FIG. 6 is partially cross-sectional side view of an opening arrangement according to another embodiment of the invention.

As a modified embodiment of the present invention, it is possible, in association with the outer sealing portion 4, to provide a removable ring 16 of plastic seen in FIG. 6, which is secured or sealed to the edge of the pouring spout 12. This pull-ring 16 is torn off before opening of the opening arrangement 1 proper and thereby provides a safeguard against the unauthorized opening of the container package 2, 5.

As will have been apparent from the above description, the present invention realizes an opening arrangement for conventional container packages or cartons which is simple to open and reseal. The opening arrangement is furthermore relatively cheap to manufacture and, as a result of the penetration devices characteristic of the present invention, the user will obtain a pouring spout which makes possible pouring of the contents of the container package without spilling and without dripping.

What is claimed is:

1. An opening arrangement for a container package comprising:

a sealing portion formed with a threaded interior configuration;

a pouring spout, one end of the pouring spout being attachable to a container package, another end of the pouring spout, forming a continuous, liquid-tight part, the pouring spout being formed with a threaded exterior configuration corresponding to the threaded interior configuration of the sealing portion, the pouring spout being inflexibly engaged with and at least partially surrounded by the sealing portion; and at least two penetration devices extending inwardly from the threaded interior configuration of the sealing portion toward the pouring spout.

2. The opening arrangement as set forth in claim 1, wherein the penetration devices are positioned at different levels within the sealing portion.

3. The opening arrangement as set forth in claim 1, wherein the penetration devices are four in number.

4. The opening arrangement as set forth in claim 1, wherein the pouring spout of the opening arrangement is made of a material which includes thermoplastic.

5. The opening arrangement as set forth in claim 4, further comprising a container package, wherein the thermoplastic material forms a part of an upper end wall of the container package.

6. The opening arrangement as set forth in claim 1, wherein the sealing portion is a screw stopper.

7. The opening arrangement as set forth in claim 1, further comprising a ring formed with the sealing portion, the ring being secured against an edge of the pouring spout such that it is necessary to remove the ring before opening of the container package.

8. The opening arrangement as set forth in claim 4, wherein the thermoplastic includes polyethylene.

9. An opening arrangement for a container package, comprising:

a sealing portion formed with a threaded interior;

a pouring spout, a first end of the pouring spout being attachable to a container package, a second end of the pouring spout being formed as a continuous, liquid-tight part, a portion of the exterior of the pouring spout conforming to the threaded interior of the sealing portion; and at least one penetration device extending inwardly from the threaded interior of the sealing portion and into the pouring spout such that the penetration device severs the second end of the pouring spout from the first end when the sealing portion is rotated.

10. The opening arrangement as set forth in claim 9, wherein two or more penetration devices are provided, the penetration devices being positioned, on the threaded interior of the sealing portion, at different levels, such that a substantially horizontal edge is formed when the second end of the pouring spout is severed from the first.

11. The opening arrangement of claim 9, wherein the pouring spout is formed by vacuum molding material in a mold formed by the threaded interior of the sealing portion.

* * * * *